United States Patent [19]

Lohati et al.

[11] Patent Number: 4,577,625

[45] Date of Patent: Mar. 25, 1986

[54] ROTATING BALL MASSAGER

[76] Inventors: Aladar Lohati; Gizella Lohati, both of 1310 Morningside Way, Venice, Calif. 90291

[21] Appl. No.: 600,555

[22] PCT Filed: Nov. 15, 1982

[86] PCT No.: PCT/US82/01621

§ 371 Date: Mar. 6, 1984

§ 102(e) Date: Mar. 6, 1984

[87] PCT Pub. No.: WO84/02410

PCT Pub. Date: Jun. 21, 1984

[51] Int. Cl.[4] ..... A61H 15/00

[52] U.S. Cl. ..... 128/57

[58] Field of Search ..... 128/24.3, 24.4, 57, 128/58, 61, 62 R, 63; 272/127

[56] References Cited

FOREIGN PATENT DOCUMENTS

| | | | |
|---|---|---|---|
| 72555 | 2/1893 | Fed. Rep. of Germany | 128/58 |
| 591232 | 12/1933 | Fed. Rep. of Germany | 128/57 |
| 717030 | 4/1939 | Fed. Rep. of Germany | 128/57 |
| 772408 | 10/1934 | France | 128/57 |
| 1199464 | 12/1959 | France | 128/57 |

*Primary Examiner*—Richard J. Apley
*Assistant Examiner*—David J. Brown
*Attorney, Agent, or Firm*—Albert O. Cota

[57] ABSTRACT

An improved rotating ball massager that allows an individual to manually massage oneself or another person. The massager is configured in the form of a flexible mitten. The mitten has attached around its side edges a side strip having a plurality of slots, cut along its length, into which is inserted a cross-joint. To the vertical tube section of each cross-joint set is attached a rotating circular bead assembly. The assembly includes a plurality of rotatable knurled beads that extend across the width of the mitten. When the mitten is moved back-and-forth under pressure of the hand against a skin surface, the rotating beads impart a soothing affect to tired and aching muscles. The massager can also be used in combination with an electric vibrator and/or a heating element. These additional implements further add to the relief of aches and the therapeutic effects provided by the massager.

7 Claims, 29 Drawing Figures

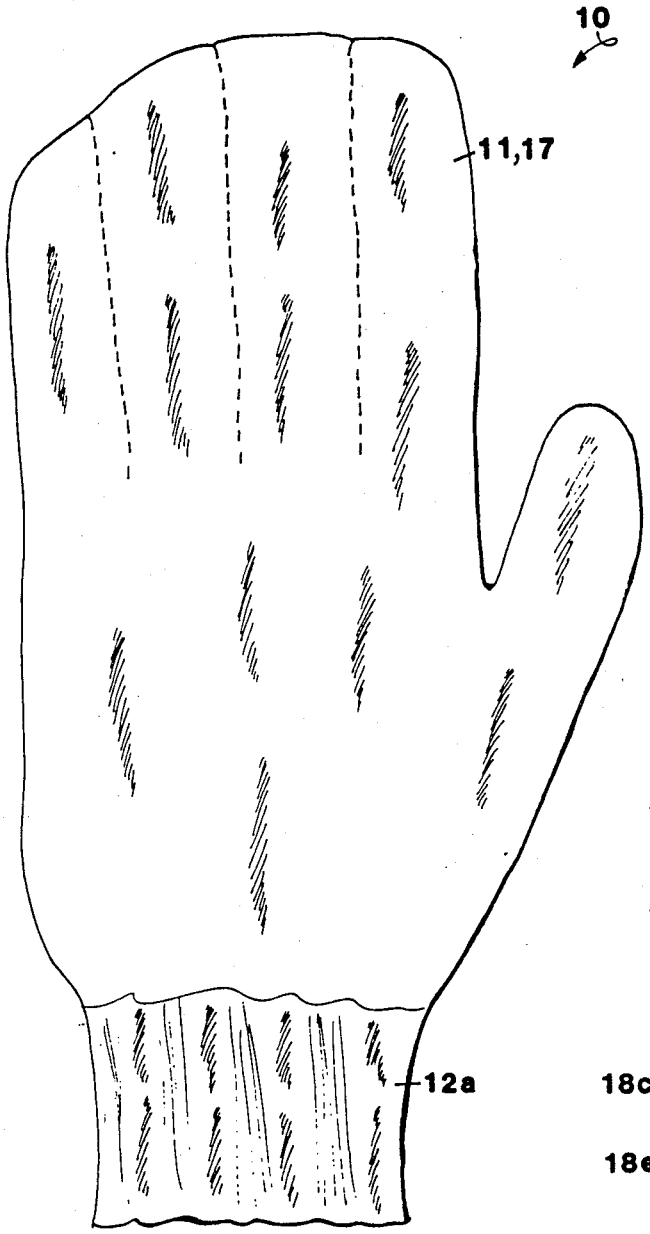
Fig. 7
Fig. 8
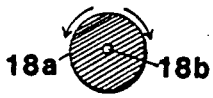
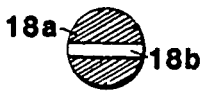
Fig. 9
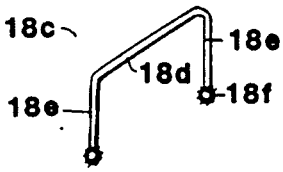
Fig. 10

Fig. 11
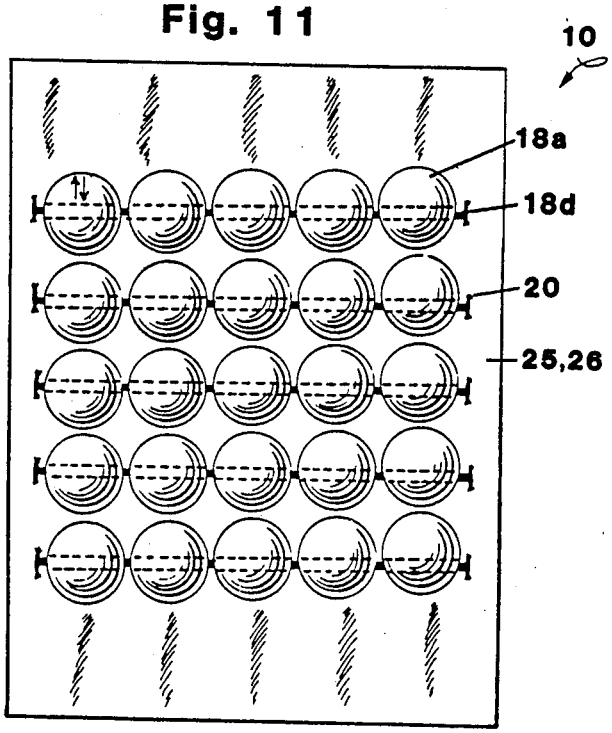
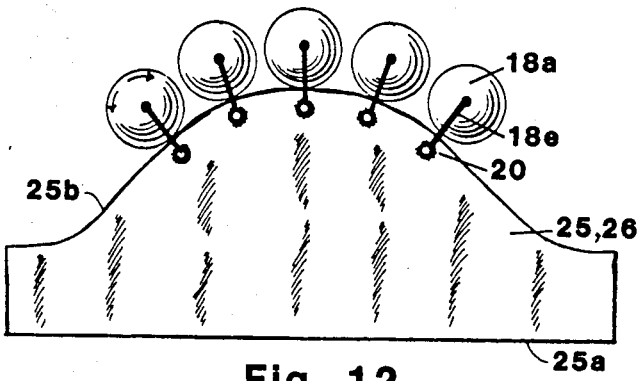
Fig. 12

ROTATING BALL MASSAGER

This application is a continuation-in-part of Ser. No. 06/395,925 filed July 7,1982, now abandoned.

TECHNICAL FIELD

This invention pertains to the field of body massaging apparatuses, and more particularly to apparatuses that use captive rotating balls or beads to enhance the effect of the massage.

BACKGROUND ART

The massaging of the human body has long been used for relieving body aches, for providing therapeutic effects and for the generally soothing effect it imparts on the person being massaged. Massagers generally use their bare hands when giving a massage. However, aiding implements such as electric vibrators, rolling pins, pebbles and balls or a combination of the above have been used to amplify the beneficial effect of the massage. Most of these implements, other than the electric vibrator, are difficult to use, are easily misplaced and limited in their use because of their bulkiness and awkwardness in holding and maintaining the implement in a desired body location.

A search of the prior art did not disclose any patents that read on the claims of the instant invention. However, U.S. Pat. No. 4,198,962 entitled "Foot Massager" issued to McCauley on Apr. 22, 1980 was considered related. This patent discloses a foot massager comprising of a frame, supporting a plurality of parallel rods and a plurality of rotatable balls mounted on the rods. The rods are attached to the frame to provide a generally convex arcuate massaging surface. A vibrator is attached to the structure to provide vibrational energy to the balls.

DISCLOSURE OF THE INVENTION

The improved rotating ball massager is comprised of several embodiments where each embodiment makes use of either a rotating ball assembly or a rotating circular bead assembly. The assemblies are permanently attached to the palm, finger and thumb areas of a glove or mitten, to various shapes of cushions/cushion enclosures, or to a single fabric or a two-ply air filled fabric that is stretched and attached to a rigid frame. The glove and mitten embodiments particularly solve the problems that occur when hand-held loose balls, pebbles and the like as are used to give a massage. Some embodiments of the improved rotating ball massager can also be used in combination with electric vibrators and/or heating elements to further add to the relief of aches and to the therapeutic effect provided by a massage.

In addition to providing a massaging apparatus that offers instant relief to tired, aching muscles and nerves by simple pressure of the hand and/or fingers, it is also an objective of the invention to provide a massager that:

can be used by both non-professional persons as well as professional masseurs, masseures and therapists, can be easily manipulated by an individual without assistance from another person, can be operated as a single unit or attached to and used in conjunction with electrical vibrators and/or heating elements, and can be easily and inexpensively manufactured.

BRIEF DESCRIPTION OF THE DRAWINGS

The details of the improved rotating ball massager are described in connection with the accompanying drawings in which:

FIG. 7 is a plan view of the non-massaging surface of the mitten shown in FIG. 5.

FIG. 8 is an end view of one of the beads used in the rotating circular bead assembly.

FIG. 9 is a cross sectional view showing the bore through the beads used in the rotating circular bead assembly.

FIG. 10 is a perspective view of the rod used to hold the beads of the rotating circular bead assembly.

FIG. 11 is a plan view of the bell-shaped rectangular cushion/enclosure massager with a plurality of the rotating circular bead assemblies attached.

FIG. 12 is a end view of the bell shaped surface of the rectangular cushion/enclosure massager shown in FIG. 11.

BEST MODE FOR CARRYING OUT THE INVENTION

The improved rotating ball massager 10 is described in terms of eight embodiments. The best mode for carrying out the invention, or preferred embodiment, is comprised of a combination of two elements: a flexible hand enclosure 11 and a rotating ball assembly 13.

Figures 1, 2, 3:
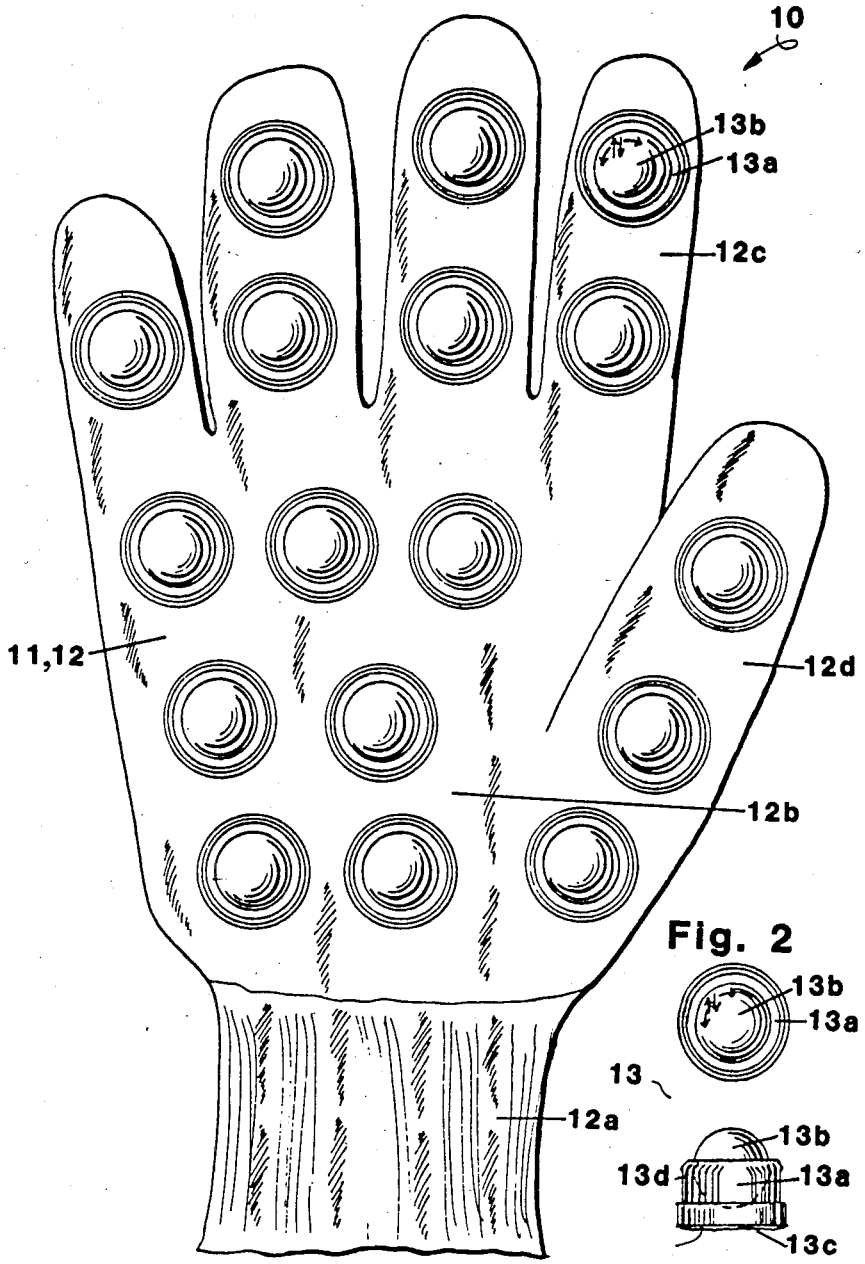
FIG. 1 is a plan view of the massaging surface of the glove with a plurality of rotating ball assemblies attached.
FIG. 2 is a top view of the rotating ball assembly.
FIG. 3 is a side view of the rotating ball assembly.
Figure 5:
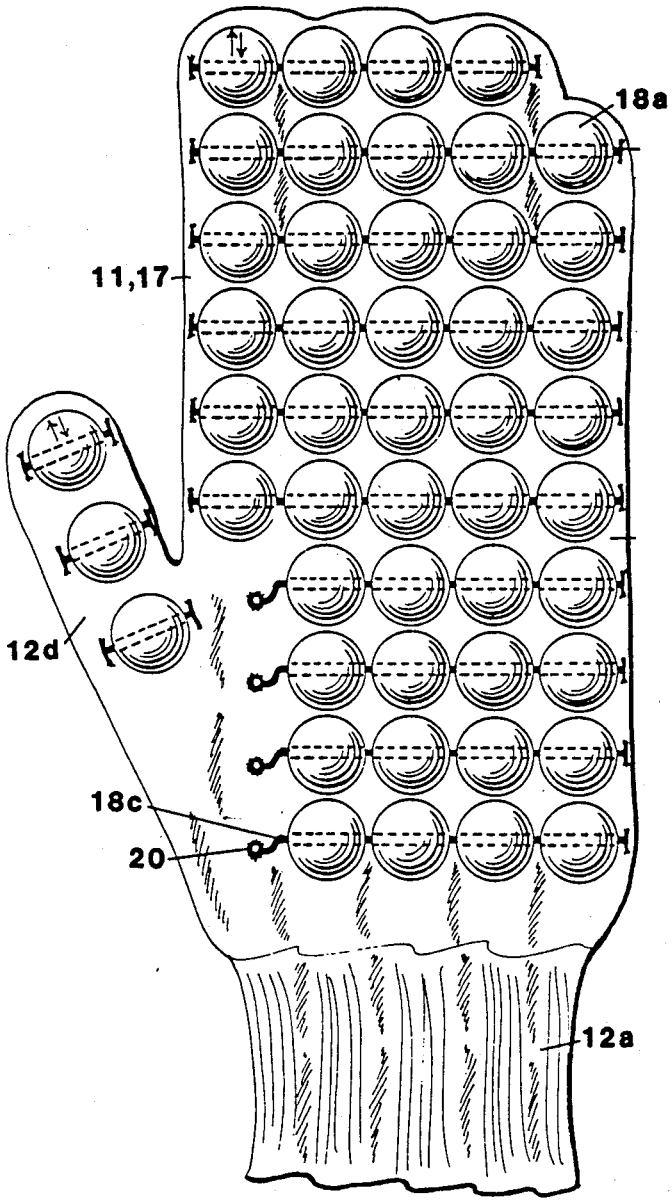
FIG. 5 is a plan view of the massaging surface of the mitten with a plurality of the rotating circular bead assemblies attached.
Figure 6:
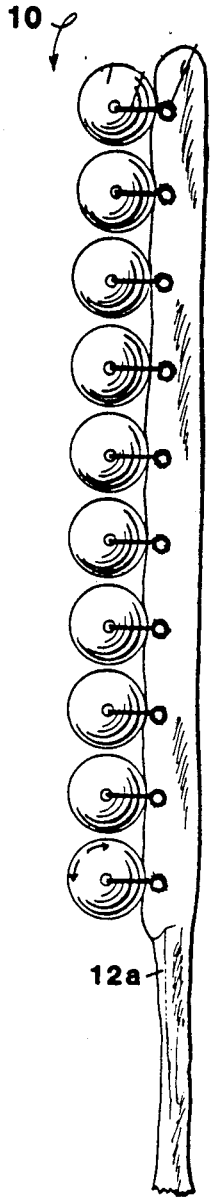
FIG. 6 is a side view of the mitten shown in FIG. 5.

The hand enclosure 11 may be either a glove 12 as shown in FIG. 1 or a mitten as shown in FIGS. 5 and 6. The glove in the preferred embodiment is made of canvas with an elasticized ribbing 12*a* located around the wrist area. However, any suitable flexible material may be used.

The rotating ball assembly 13, as shown in FIGS. 2 and 3, is comprised of a cylindrical base 13*a* and a circular ball 13*b* where both parts may be made of plastic, wood, metal, or a resilient material such as hard rubber with plastic being preferred. The base 13*a* has a flat bottom surface 13*c* and a concave upper surface 13*d* that is dimensioned to rotatably retain the ball 13*b*. Thus, the assembly 13 allows the ball 13*b* to rotate easily in all directions while remaining captive within the base 13*a*.

To combine the two elements 11, 13 into a functional massaging embodiment a plurality of rotating ball assemblies 13 are attached to the glove 12 in an arrangement that effectively covers the glove palm 12*b*, and the bottom surface of the fingers 12*c* and thumb 12*d*. In the preferred embodiment, as shown in FIG. 1, a total of seventeen assemblies are attached to the glove. The attachment of the assembly 13 to the glove 12 is accomplished by applying an adhesive substance 14, such as a permanent setting cement, to the bottom surface 13*c* of the base 13*a* and placing the base on the designated area on the glove. To use the improved rotating ball massager the glove is slipped into the hand and the hand is manipulated about a body region to provide the massage. To further enhance the massage, a hand-held electric vibrator 35 may be strapped to the glove 12 or mitten 17.

The second embodiment of the improved rotating ball massager 10 is also comprised of a combination of two elements: a hand enclosure 11 and a plurality of rotating circular bead assemblies 18.

Figure 4:
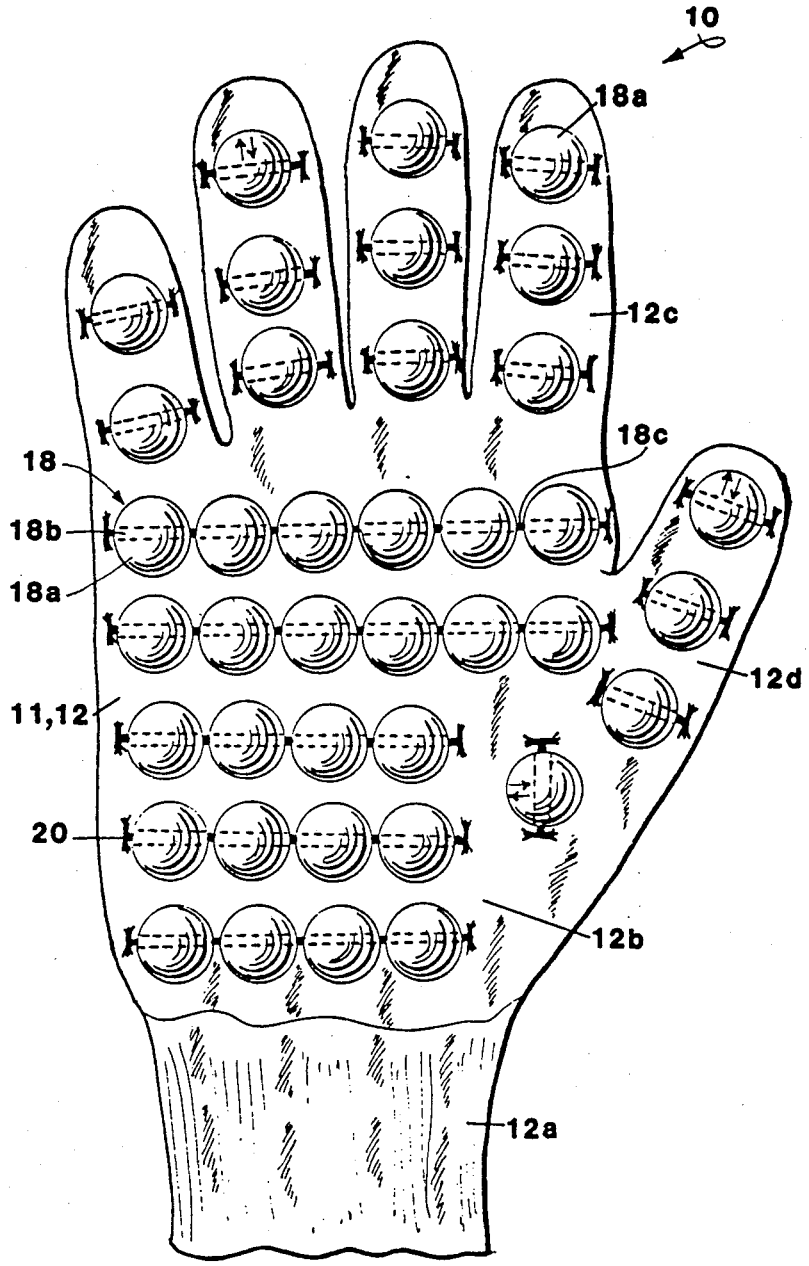
FIG. 4 is a plan view of the massaging surface of the glove with a plurality of the rotating circular bead assemblies attached.

The hand enclosure 11 may be either a glove 12, as shown in FIG. 4, or a mitten 17, as shown in FIGS. 5, 6 and 7. The glove or mitten, in the second embodiment, is also made of canvas or an equivalent material with an elasticized ribbing 12*a* located around the wrist area.

The rotating circular bead assembly 18, as shown attached to a glove 12 and a mitten 17 in FIGS. 4, 5 and 6 respectively, is comprised of either a plurality of circular beads or balls 18*a* or a single bead or ball 18*a* and a correspondingly sized rod 18*c*. The circular bead(s) 18*a* are circular in shape and have a central bore 18*b* therethrough as best shown in FIGS. 8 and 9. The beads or balls may be made of plastic, wood or metal or a resilient material such as hard rubber.

The rod 18*c*, as best shown in FIG. 10, consists of a horizontal section 18*d* with a contiguous 90-degree vertical section on each end. When completely shaped, the rod resembles an inverted square "U". The rod has a diameter that allows the circular beads 18*a* to be easily inserted and rotated about the horizontal section 18*d* of the rod. The length of the vertical sections are chosen to allow the beads to easily rotate against the surface of the hand enclosure 11.

To assemble the rotating circular bead assembly 18 one of the vertical ends is initially bend downwardly and the bead(s) 18*a* are inserted into the rod. Once all the beads are inserted, the remaining vertical section is bend downwardly at a point that allows sufficient lateral bead movement to assure that the beads can rotate freely. Thus, maintaining the beads in a captive position as best shown in FIG. 4. The ends of the vertical sections may terminate in an "L" shape, "T" shape or an eyelet 18*f* as shown in FIG. 10. Whatever, the shape of the terminating end, its purpose is to allow the assembly 18 to be attached to the hand enclosure 11 by wrapping and stitching 20 the ends to the surface of the hand enclosure 11. Other attach methods may also be used, i.e., having grooved vertical ends that when inserted into a spring-loaded locking eyelet automatically lock, where the eyelets are located on the surface of the hand enclosure 11.

The single or plurality configuration of the circular bead assemblies are arranged and attached to conform to the particular shape of the hand enclosure. For example, in the glove 12 configuration, as shown in FIG. 4, five assemblies 18 with plurality beads are arranged in parallel rows extending from the front to the back of the palm surface. Additionally, there are also single bead assemblies extending across the length of the fingers and thumb with one single bead assembly 18 attached near the bottom of the thumb area approximately normal to the rotational angle of the majority of the other assemblies 18.

In the mitten configuration, as shown in FIGS. 5 and 6, ten assemblies 18 with plurality beads are arranged in parallel rows extending from the top to the bottom of the mitten palm and three single bead assemblies 18 are attached in the thumb area. With either the glove or mitten bead assembly arrangement an optimum massaging configuration is achieved, and as in the preferred embodiment, the glove or mitten may also be used with a hand-held electric vibrator.

The third embodiment of the improved rotating ball massager 10, as shown in FIGS. 11 and 12, is designed to be used as a hand-held unit to massage the neck and shoulder area or it can be placed on the floor and used as a foot massager. This embodiment is comprised of a combination of three elements: a resilient rectangular cushion 25, a flexible rectangular enclosure 26, and a plurality of rotating circular bead assemblies 18.

Figure 13:
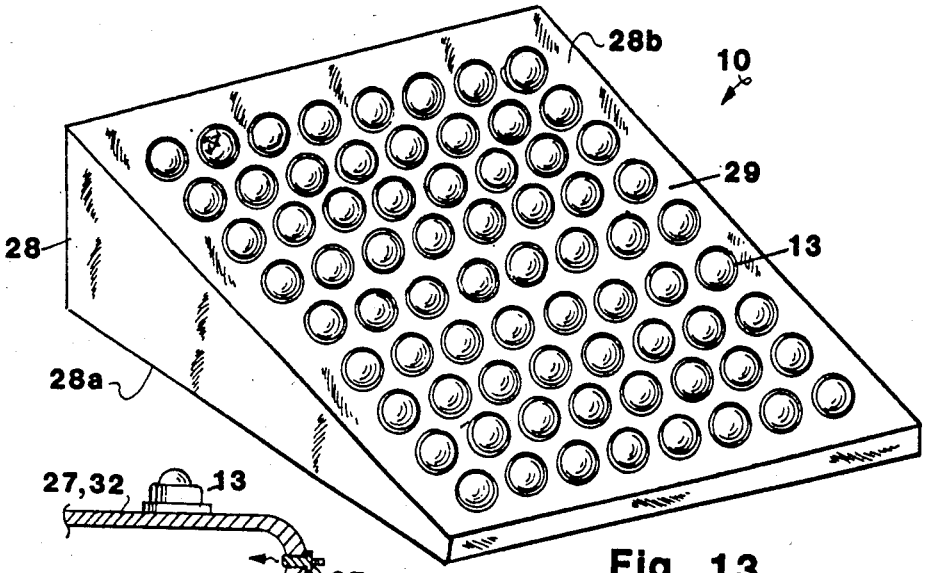
FIG. 13 is a perspective view of the rectangular/angled cushion/enclosure with a plurality of the rotating ball assemblies attached.

The cushion 25 is constructed of a resilient material such as a urethane foam and is configured with a lateral and centrally located bell shaped upper surface 25*b* that extends over the length of the rectangular cushion as best shown in FIG. 13.

The flexible rectangular enclosure 26 is designed to fit snugly over the cushion 25 and is made of canvas or other equivalent material. The enclosure may be left open on one end or sealed by means of a zipper or snaps.

A plurality of rotating circular bead assemblies 18 are arranged in parallel rows extending laterally over the crest of the bell shaped upper surface 25*b* of the flexible rectangular enclosure 26 as best shown in FIG. 12. For this particular embodiment a total of five assemblies each having five beads were used. The general description of the assembly 18 and its attachment methodology is identical to that described for the second embodiment. Also it should be noted that the number of balls per assembly as well as the diameter of the balls is dependent upon the size and use of the massaging device.

The fourth embodiment of the improved rotating ball massager 10, as shown in FIG. 13, is designed to be placed on a chair for massaging the upper and lower back. This embodiment is also comprised of three elements: a resilient rectangular/angled cushion 28, a flexible angled enclosure 29, or a flexible angled two-ply enclosure 27 and a plurality of rotating ball assemblies 13.

The cushion 28 is constructed of a resilient material such as a urethane foam and is configured as shown in FIG. 13, with a flat back side 28*a* and an inclined front side 28*b* with the incline tapering at the top of the cushion. With this configuration the cushion can be placed on the back of a chair or on a bed to provide an optimum massaging angle surface.

Figure 14:
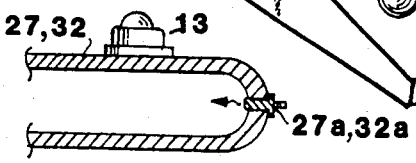
FIG. 14 is a cutaway section of a typical two-ply fabric shown with a check valve attached to one side.

The flexible angled enclosure 29 is designed to fit snugly over the cushion and is made of canvas or other equivalent material. The enclosure may be left open on one end or sealed by means of a zipper or snaps. An alternative enclosure may also be used that has a hermetically sealed two-ply fabric 27, as shown in FIG. 14, located on the upper or functional side of the enclosure 29. Attached to one side of the two-ply fabric is an air inlet check valve 27*a*. The check valve allows air to enter and fill the fabric while preventing air from escaping. A sufficient quantity of air is inserted to allow an air cushion to be formed. The air cushion allows the rotating ball assemblies 13 to rotate easily even when excessive body weight is applied to the fabric.

A plurality of rotating ball assemblies 13 are arranged to effectively cover the inclined front side 28*b* of the flexible angled enclosure 27 or 29 as shown in FIG. 13. For this particular embodiment, a total of seventy-two assemblies 13 were used. The general description of the assembly 13 and its attachment methodology is identical to that described for the preferred embodiment.

The third and fourth embodiments are especially suited for having a conventional heating element placed between the cushion 25, 28 and the enclosure 26, 29 respectively. The heating element further enhances the therapeutic and soothing effects provided by the massage.

Figure 15:
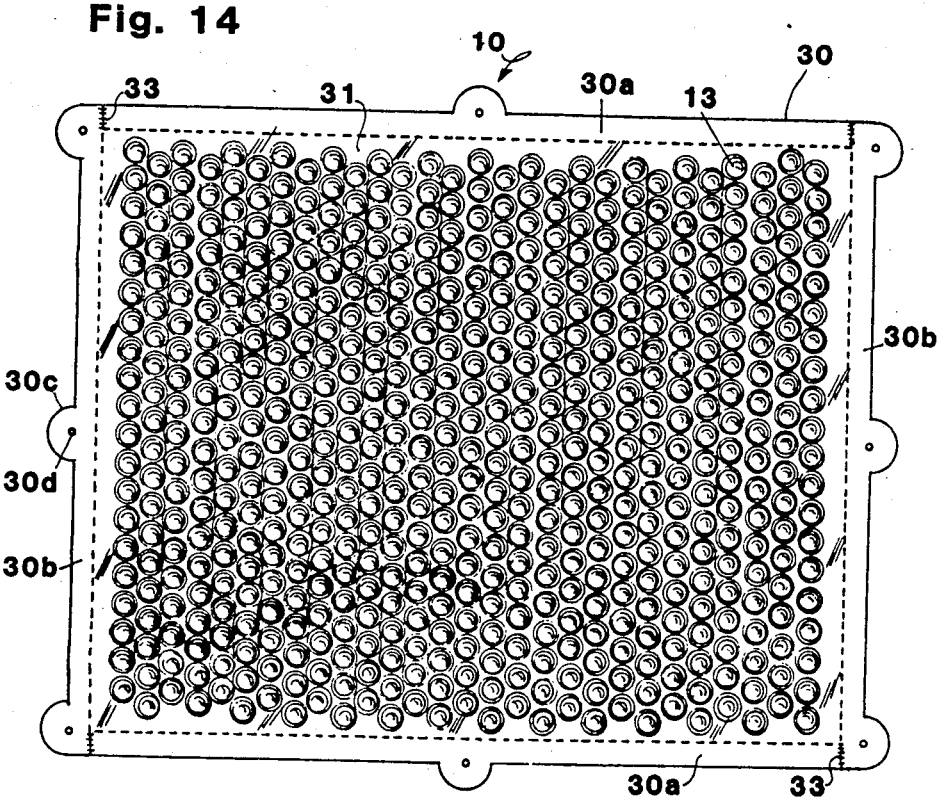
FIG. 15 is a plan view of the rigid frame and stretched fabric massager with a plurality of the rotating ball assemblies attached.

The fifth embodiment of the improved rotating ball massager 10, as shown in FIG. 15, is dimensioned to be placed on top of a bed for massaging in a prone position or hung on a wall for massaging in a standing position. This embodiment is comprised of a combination of three elements: a rigid frame 30, a resilient body-support fabric 31, or a resilient body support two-ply fabric 32 and a plurality of rotating ball assemblies 13.

The rigid frame 30 is of a rectangular shape and is dimensioned preferably to fit on top of a single bed. The frame is constructed by joining two frame side members 30*a* to two corresponding frame end members 30*b*. The joint is accomplished by either welding 33 or bolting (not shown) the pieces together. Around the periphery of the frame are located a series of contiguous tabs 30*c* having a hole 30*d* therein. The tabs are located on each corner of the frame and are centered on each frame side member 30*a* and frame end member 30*b*. The tabs are used for hanging the frame on a wall or fastening the frame to a bed.

The resilient body-support fabric 31 is dimensioned to fit on top of the frame 30 in a stretched condition. The preferred method for attaching the fabric 31 to the frame 30 is by a heat process that fuses the bottom of the fabric to the upper surface of the frame. However, other conventional attachment methods that allow the fabric to be stretched over the frame may be used. An alternative fabric, as shown in FIG. 14, may also be used. This fabric is comprised of a hermetically sealed two-ply fabric 32 having an air inlet check valve 32*a* on one or two sides. The check valve 32*a* allows air to enter into the fabric 32 while preventing air from escaping. A sufficient quantity of air is inserted into the fabric to allow an air cushion to be formed. The air cushion allows the rotating ball assemblies 13 to rotate easily even when excessive body pressure is applied to the fabric. Fabrics filled with permanent captive air may also be used. In this type of fabric, air is carried in partitioned sections where one or two rotating ball assemblies 13 per section can be attached.

A plurality of rotating ball assemblies 13 are arranged to effectively cover the usable resilient area of the fabric 31 or 32 as shown in FIG. 14. For this embodiment a total of 560 assemblies 13 were used. The general description of the assembly 13 is identical to that described for the first embodiment. However, the preferred method for attaching the assembly 13 to the fabric 31 is by a heat process that fuses the bottom surface of the assembly to the upper surface of the fabric.

Figure 16:
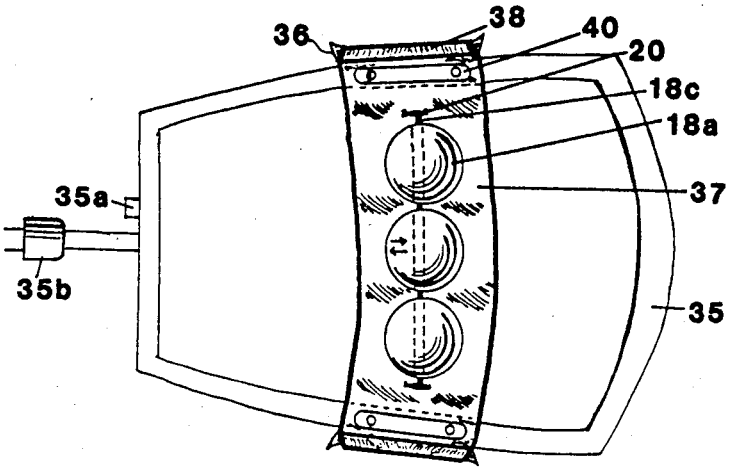
FIG. 16 is a top view of an electric hand-held electric vibrator having attached the band of elastic material with the rotating circular bead assembly.
Figure 17:
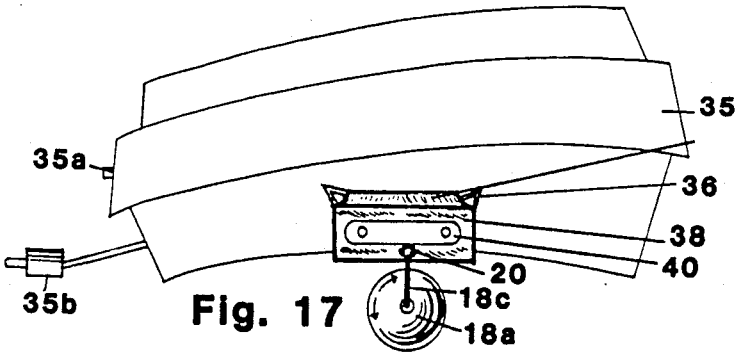
FIG. 17 is a side view of the electric hand-held electric vibrator having attached the band of elastic material with the rotating circular bead assembly.
Figure 18:
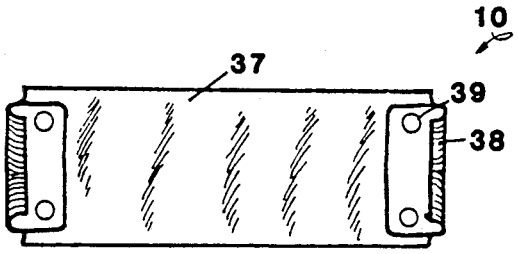
FIG. 18 is a bottom view of the band of elastic material shown with the band clips attached.

The sixth embodiment of the improved rotating ball massager 10, as shown in FIGS. 16, 17 and 18, is designed to be used with a standard hand-held electric vibrator, this embodiment is comprised of a combination of five elements: the standard hand-held electric vibrator 35, a set of vibrator clips 36, a band of elastic material 37, a set of band clips 38, and a single rotating circular bead assembly 18.

The electric vibrator 35 has an on-off switch 35*a* and a standard power cord and connector 35*b*, and is modified by attaching (when required) a vibrator clip 36 on each side of the vibrator as shown in FIGS. 16 and 17. The clips 36 are attached to the vibrator by conventional means such as by a permanent setting adhesive.

The band of elastic material 37 has attached to each end a band clip 38 as shown in FIG. 18. The clips are sized and designed to allow them to securely clip on to the ends of the vibrator clips 36 as best shown in FIG. 17. The clips are attached to the band by conventional means such as by a combination of rivets 39 and an enforcement rivet plate 40.

The single rotating circular bead assembly 18, as best shown in FIG. 16, has a rod 18*c* sized to contain three beads 18*a*. The assembly 18 is placed along the length of the band 37 to allow the beads 18*a* to rotate when the hand-held electric vibrator 35 is moved in a forward and backward direction. Thus, this embodiment produces a vibrating motion in addition to the rotating action of the beads.

The seventh embodiment of the improved rotating ball massager is comprised of four major elements: a flexible hand enclosure in the form of a mitten 50, a side strip 50*a*, a cross-joint 52, and a plurality of rotating circular bead assemblies 54.

Figure 19:
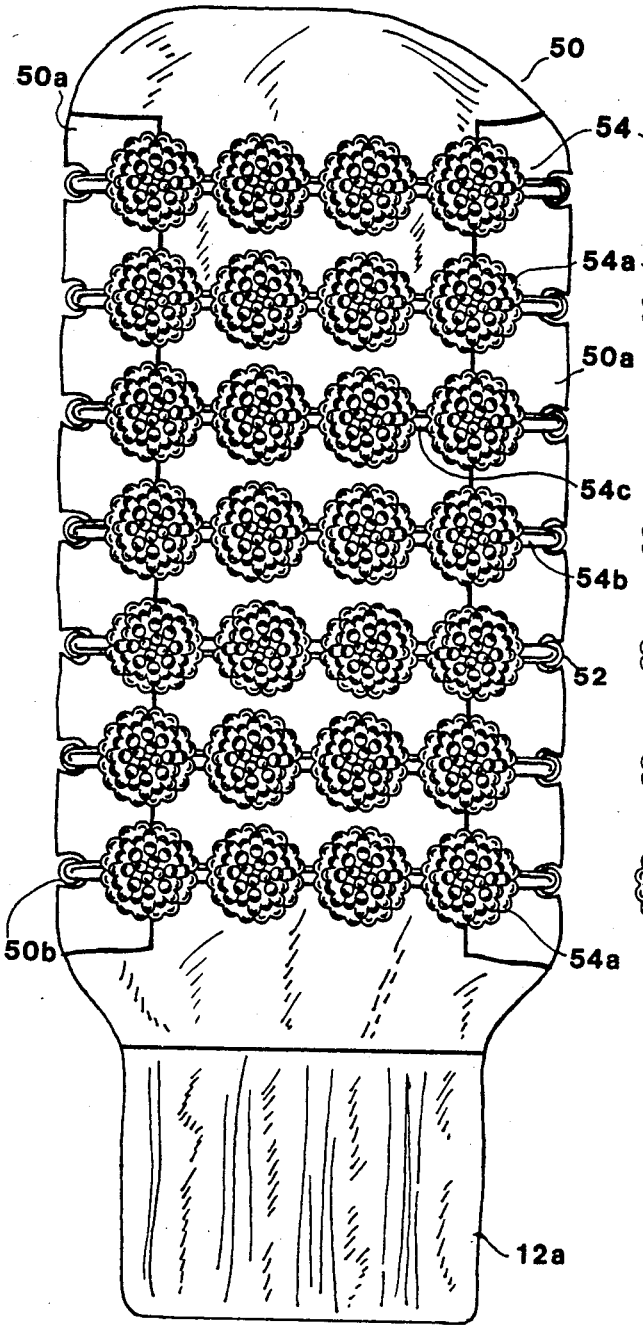
FIG. 19 is a plan view of the seventh embodiment showing a plurality of rotating circular bead assemblies attached.
Figure 20:
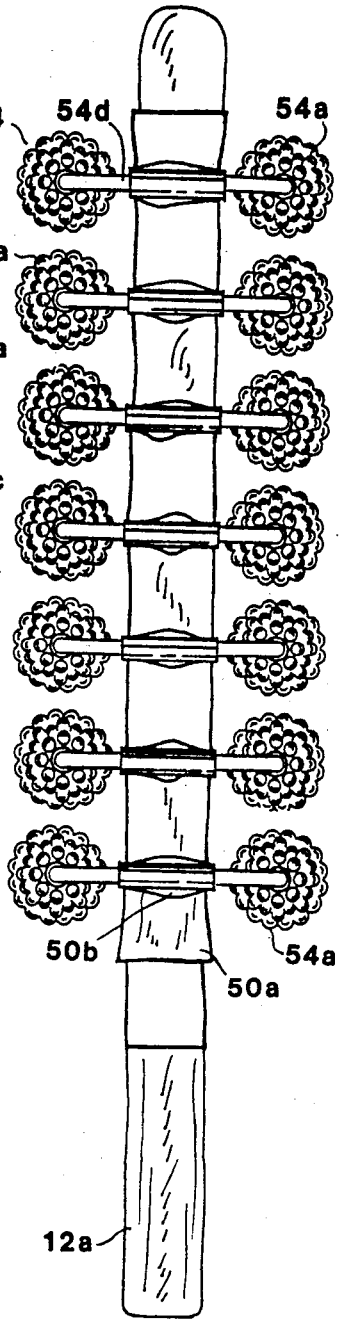
FIG. 20 is a side view of the seventh embodiment showing a plurality of rotating circular bead assemblies attached to each side of the hand enclosure.

The mitten 50 is preferably made of leather with an elasticized ribbing 12*a* located around the wrist area. Around the side edges, as shown in FIGS. 19 and 20, is attached the side strip 50*a*. This side strip is also preferably made of leather and has, as best shown in FIG. 20, a plurality of slots 50*b* cut perpendicular to the length of the mitten 50. The slots provide an opening to the side surface of the mitten 50 into which is inserted the cross-joint 52. The side strip 50*a* may be attached to the mitten 50 by either an adhesive or by blind stitches with the adhesive method preferred.

Figure 21:
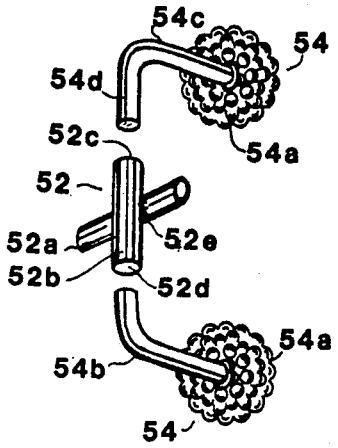
FIG. 21 is a perspective view of the cross-joint and the end sections of the rotating circular bead assemblies prior to insertion into the vertical tube.
Figure 23:
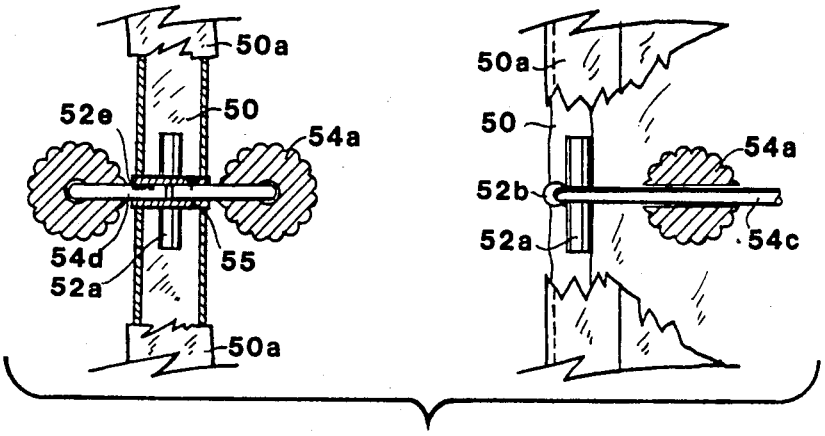
FIG. 23 is a partial sectional view of the top and side of the rotating bead assembly attached to the cross-joint.
Figure 22:
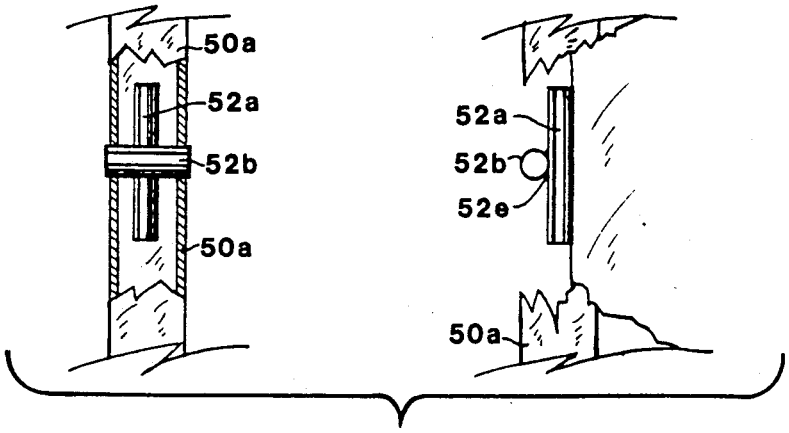
FIG. 22 is a partial sectional view of the top and side of the cross-joint set into the hand enclosure before the rotating bead assembly is attached.

The cross-joint 52 as best shown in FIGS. 21 and 22, is comprised of a horizontal rod 52*a* and a vertical tube 52*b* having an upper opening 52*c* and a lower opening 52*d*. Both members are preferably made of a solderable metal. The vertical tube 52*b* is centrally attached at an angle of 90-degrees to the horizontal rod by a soldering process 52*e*. The assembled cross-joint 52 is then inserted into each of the slots 50*b* located on the side strip 50*a*, such that the vertical tube 52*b* has the opening oriented at 90-degrees with respect to the length of the mitten 50. The horizontal rod 52*a* is held in place within the side strip 50*a* by the pressure of the side strip against the side edges of the mitten 50 as best shown in FIGS. 20 and 23. The vertical tube is sized to allow the openings 52*c*, 52*d* to extend slightly above and below the side strip 50*a* as best shown in FIG. 22.

The rotating circular bead assembly 54 used in the seventh embodiment is similar to the assembly 18 described in the second embodiment except for the following exceptions: in this embodiment the plurality of beads are configured as knurled beads as best shown in FIGS. 19 and 20. The knurled surface allows a more pleasing point-contact to be made with the skin surface being massaged.

The bead retaining rod 54*b* is also comprised of a horizontal center section 54*c* and a contiguous downwardly angled vertical section 54*d* on each end. In this embodiment the diameter of the rod 54*d* is selected to allow the vertical sections 54*d* to tightly fit into the upper and lower openings 52*c*, 52*d* of the vertical tube 52*b* on the cross-joint 52. The vertical section 54*d* is held captive within the vertical tube, as shown in FIG. 23, by crimping 55 the edges or by a soldering process 52*e* with the crimping method preferred.

The eighth embodiment of the improved rotating ball massager is comprised of three elements: a flexible hand enclosure in the form of a thumb-mitten 60, a bead assembly holding strip 62, and a plurality of rotational circular bead assemblies 64.

Figure 24:
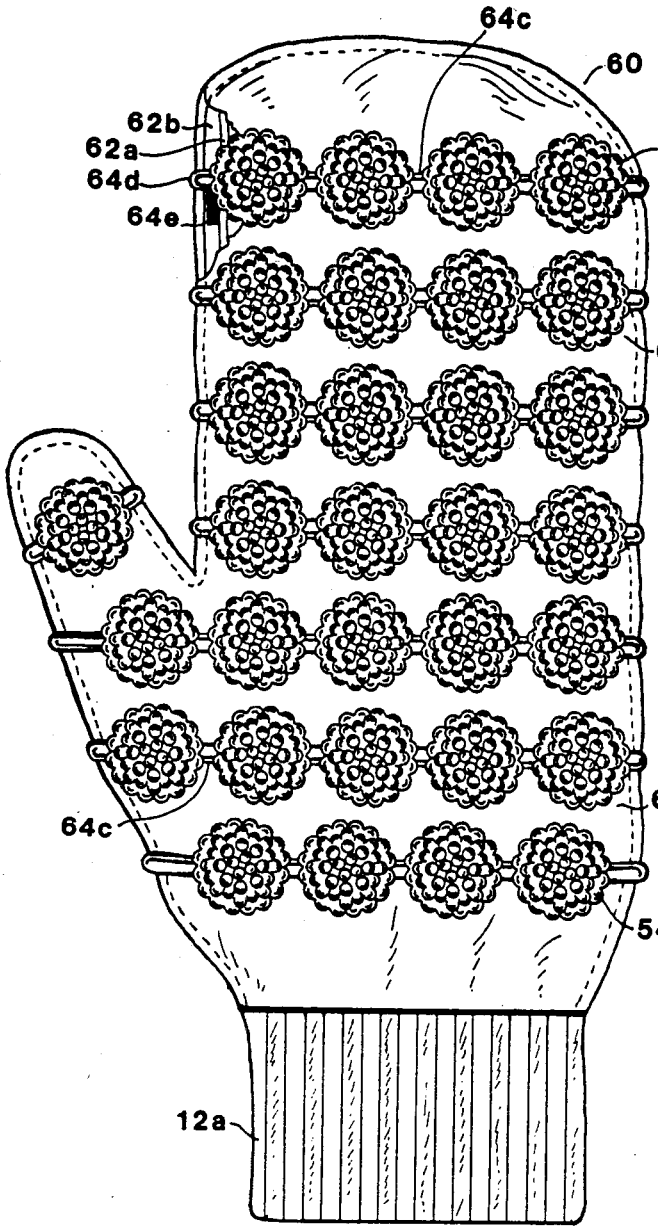
FIG. 24 is a plan view of the eighth embodiment showing a plurality of rotational circular bead assemblies attached and a partial sectional view of the bead assembly holding channel with a vertical rod attached.
Figure 25:
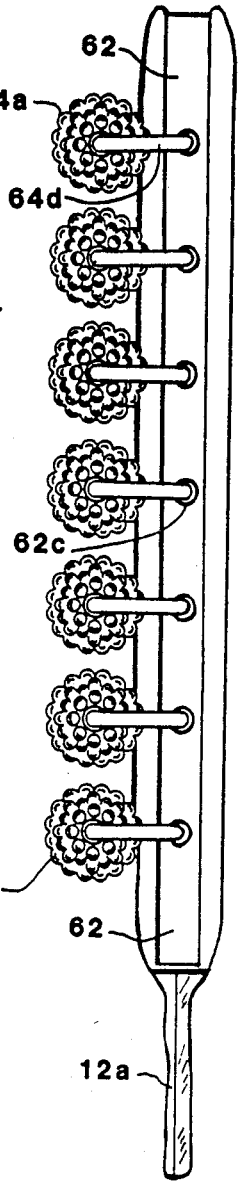
FIG. 25 is a side view of the eighth embodiment showing the placement of the bead assembly holding channel.
Figure 27:
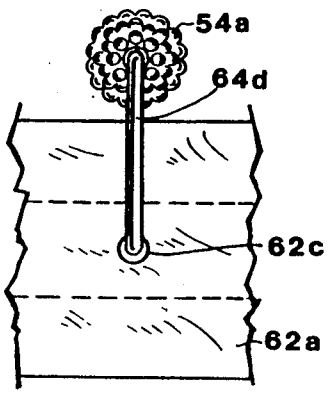
FIG. 27 is an outer side view of the bead assembly holding channel showning one side of a rotational circular bead assembly attached.

The mitten 60 in this embodiment is preferably made of a cloth material with an elasticized ribbing 12*a* located around the wrist area. Although the ribbing is preferred, other wrist tightening means may be used in this and the other applicable embodiments such as a belt and buckle combination or a Velcro fastener. Around the side edges and around the thumb sides is attached the bead assembly holding strip 62 as shown in FIGS. 24 and 25.

Figure 26:
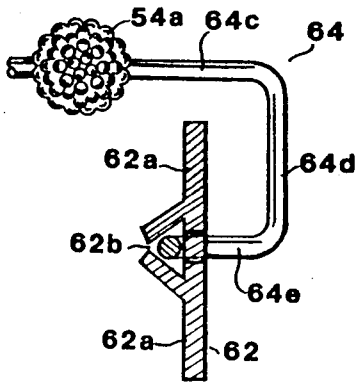
FIG. 26 is an end view of the bead assembly holding channel showning one side of rotational circular bead assembly attached.
Figure 28:
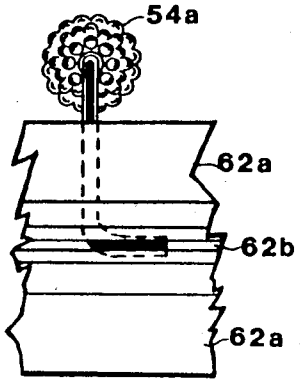
FIG. 28 is an enter side view of the bead assembly holding channel showning one side of a rotational circular bead assembly attached.
Figure 29:
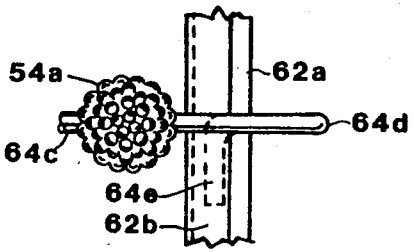
FIG. 29 is a top view of the bead assembly holding channel showing one side of a rotational circular bead assembly attached.

The bead assembly holding strip 62, as depicted in FIGS. 26–29, is comprised of an attachment base 62*a* having a contiguous channel 62*b* extending along the length of the base. Along the base length are also located a plurality of vertical rod bores 62*c*. The bores are located so that they penetrate through the center of the channel 62*b*. The holding strip 62 is attached to the mitten 60 by first cutting the sides of the mitten and then stitching the upper and lower sections of the attachment base 62*a* as best shown in FIG. 26.

The rotational circular bead assembly 64 is again basically similar to the assembly 18 described in the second embodiment except for the use of the knurled beads 54*a* as described in the seventh embodiment.

The bead retaining rod 64*b* is comprised of a horizontal center section 64*c* and a contiguous, downwardly angled vertical section 64*d* on each end. The ends of the vertical section terminate in a horizontal L-hook 64*e*. The L-hook, as shown in FIGS. 26–29, is inserted into the vertical rod bores 62*c* and snapped into the channel 62*b* of the bead assembly holding strip 62. Thus, holding the rotational circular bead assembly 64 in place.

The diameter of the rotating beads 54*a* may be selected to allow the number of beads per bead assembly to vary. As shown in FIGS. 19 and 24, the bead diameter has been selected to allow four beads per assembly.

Although the invention has been described in complete detail and pictorally shown in the accompanying drawings, it is not to be limited to such details since many changes and modifications may be made to the improved rotating ball massager without departing from the spirt and scope thereof. Hence, the invention is described to cover any and all modifications and forms which may come within the language and scope of the claims.

We claim:

1. An improved rotating ball massager comprising:

(a) a flexible hand enclosure (b) a side strip of flexible material wrapped and attached around the side edges of said hand enclosure with said strip having a plurality of slots cut perpendicular to the length of the enclosure where the slots provide an opening into the side surface of said hand enclosure, (c) means for attaching said side strip to the side of said flexible hand enclosure, (d) a cross-joint comprised of a horizontal rod and a vertical tube having an upper and lower opening where the vertical tube is centrally attached at 90-degrees to the side of the horizontal rod, and where the horizontal rod is slipped into the slot and held within the side strip by the pressure of the side strip against the side edges of said hand enclosure, and where the upper and lower openings of said cross-joint extend slightly above and below said side strip, (e) means for attaching the vertical tube to the side of the horizontal rod on said cross-joint, (f) a rotating circular bead assembly comprising:

(1) a plurality of circular knurled beads each having a central bore therethrough, (2) a bead retaining rod having a horizontal center section with a contiguous downwardly angled vertical section on each end, with said rod having a diameter that allows the knurled beads to be easily inserted and rotated about the horizontal center section and where the length and diameter of the vertical section is sized to fit into and be captively held within the upper and lower openings of the vertical tube on said cross joint, and where the length of the vertical section is also selected to allow the beads to easily rotate against the surface of said enclosure, and (g) means for captively holding the vertical sections of the bead retaining rod within the respective vertical tube openings on said cross-joint.

2. The improved rotating ball massager as specified in claim 1 wherein the means for attaching said side strip to said flexible hand enclosure is accomplished by an adhesive.

3. The improved rotating ball massager as specified in claim 1 wherein the means to attach said side strip to said flexible hand enclosure is accomplished by a plurality of blind stitches.

4. The improved rotating ball massager as specified in claim 1 wherein the means to attach the vertical tube to the side of the horizontal rod on said cross-joint is accomplished by a soldering process.

5. The improved rotating ball massager as specified in claim 1 wherein the means to captively hold the vertical sections of said rotating circular bead assembly to the vertical tube on said cross-joint is by crimping the two members together.

6. The improved rotating ball massager as specified in claim 1 wherein the means for captively holding the vertical section of said bead retaining rod vertical tube on said cross-joint is by a soldering process.

7. The improved rotating ball massager as as specified in claim 1 wherein a set of rotating circular bead assemblies is attached to only the lower opening of said cross-joint vertical tube.

* * * * *